US011994338B2

(12) United States Patent
Hui et al.

(10) Patent No.: US 11,994,338 B2
(45) Date of Patent: May 28, 2024

(54) CONTROL METHOD FOR DRAWER DOOR OF REFRIGERATOR AND REFRIGERATOR

(71) Applicants: QINGDAO HAIER REFRIGERATOR CO., LTD., Shandong (CN); HAIER SMART HOME CO., LTD., Shandong (CN)

(72) Inventors: Bin Hui, Qingdao (CN); Shidong Li, Qingdao (CN); Zhijun Liu, Qingdao (CN); Xiaobin Hu, Qingdao (CN); Guoshuai Cao, Qingdao (CN)

(73) Assignees: QINGDAO HAIER REFRIGERATOR CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 359 days.

(21) Appl. No.: 17/430,654

(22) PCT Filed: Feb. 11, 2020

(86) PCT No.: PCT/CN2020/074740
§ 371 (c)(1),
(2) Date: Aug. 12, 2021

(87) PCT Pub. No.: WO2020/164478
PCT Pub. Date: Aug. 20, 2020

(65) Prior Publication Data

US 2022/0214102 A1 Jul. 7, 2022

(30) Foreign Application Priority Data

Feb. 15, 2019 (CN) ..... 201910117992.9

(51) Int. Cl.
*F25D 25/02* (2006.01)
*A47B 88/457* (2017.01)
(Continued)

(52) U.S. Cl.
CPC ..... *F25D 25/025* (2013.01); *F25D 23/028* (2013.01); *A47B 88/457* (2017.01);
(Continued)

(58) Field of Classification Search
CPC .... F25D 25/025; F25D 23/028; F25D 29/005; F25D 2323/02; F25D 2600/02;
(Continued)

(56) References Cited

U.S. PATENT DOCUMENTS 2,873,159 A 2/1959 Becker
7,583,040 B2 * 9/2009 Claudel ..... E05F 15/70 318/264
(Continued)

FOREIGN PATENT DOCUMENTS

CA 2638350 A1 6/2009
CN 101981397 A 2/2011
(Continued)

OTHER PUBLICATIONS

Supplementary European Search Report for EP Application No. 20755529.3 dated Feb. 8, 2022 (4 pages).
(Continued)

*Primary Examiner* — David Luo
(74) *Attorney, Agent, or Firm* — Alston & Bird LLP

(57) ABSTRACT

A control method for a drawer door of a refrigerator and the refrigerator. The refrigerator comprises a refrigerator body, a drawer door mounted in the refrigerator body in a front-back pushed and pulled mode, and a driving mechanism driving the drawer door to move forward and backward. The control method comprises: obtaining a door opening instruction or a door closing instruction; controlling the driving mechanism to drive the drawer door to move forward to open or move backward to close; detecting a resistance borne by the drawer door during the movement; determining
(Continued)

whether the resistance is greater than a preset resistance threshold; and if yes, controlling the driving mechanism to stop running to enable the drawer door to stop moving.

8 Claims, 5 Drawing Sheets

(51) Int. Cl.
*F25D 23/02* (2006.01)
*F25D 29/00* (2006.01)

(52) U.S. Cl.
CPC ..... *A47B 2210/175* (2013.01); *F25D 29/005* (2013.01); *F25D 2323/02* (2013.01); *F25D 2600/02* (2013.01)

(58) Field of Classification Search
CPC ..... F25D 2600/00; F25D 29/00; F25D 23/02; F25D 23/021; F25D 2600/06; A47B 88/457; A47B 2210/175
USPC ..... 318/466, 445
See application file for complete search history.

(56) References Cited

U.S. PATENT DOCUMENTS

| | | | | |
|---|---|---|---|---|
| 8,067,915 | B2 * | 11/2011 | Hooker | A47B 88/457 312/334.1 |
| 8,217,613 | B2 * | 7/2012 | Yoo | E05F 15/635 318/466 |
| 8,274,251 | B2 * | 9/2012 | Yoo | F25D 25/025 318/646 |
| 8,476,858 | B2 * | 7/2013 | Eom | F25D 23/021 318/257 |
| 8,497,644 | B2 * | 7/2013 | Eom | A47B 88/457 318/264 |
| 2010/0168920 | A1 | 7/2010 | Hooker et al. | |
| 2015/0027247 | A1 | 1/2015 | Kamada | |

FOREIGN PATENT DOCUMENTS

| | | | | |
|---|---|---|---|---|
| CN | 202077884 | * | 12/2011 | A47B 88/40 |
| CN | 102818426 | A | 12/2012 | |
| CN | 109057616 | A | 12/2012 | |
| CN | 202659023 | U | 1/2013 | |
| CN | 103983081 | A | 8/2014 | |
| CN | 106123469 | A | 11/2016 | |
| CN | 106225411 | A | 12/2016 | |
| CN | 108387059 | A | 8/2018 | |
| CN | 108442842 | A | 8/2018 | |
| CN | 108716338 | A | 10/2018 | |
| JP | 2009228911 | A | 10/2009 | |
| JP | 2015-166664 | A | 9/2015 | |
| JP | 2016-142506 | A | 8/2016 | |
| JP | 2018179374 | A | 11/2018 | |
| KR | 20160023460 | A | 3/2016 | |

OTHER PUBLICATIONS

1st Office Action for EP Application No. 20755529.3 dated Feb. 21, 2022 (6 pages).
1st JP Office Action for JP Application No. 2021-547174 (5 pages).
International Search Report for PCT/CN2020/074740 (ISA/CN) dated May 9, 2020 (4 pages).
1st Search Report for priority application No. CN2019101179929 dated May 12, 2020.

* cited by examiner

CONTROL METHOD FOR DRAWER DOOR OF REFRIGERATOR AND REFRIGERATOR

CROSS-REFERENCE TO RELATED APPLICATIONS

The present application is a national phase entry of International Application No. PCT/CN2020/074740, filed Feb. 11, 2020, which claims priority to Chinese Patent Application No. 201910117992.9, filed Feb. 15, 2019, which are incorporated herein by reference in their entireties.

TECHNICAL FIELD

The present invention relates to a refrigerating and freezing device, in particular to a control method for a drawer door of a refrigerator and the refrigerator.

BACKGROUND ART

Some refrigerators, such as French refrigerators, are provided with a drawer door structure. That is, a drawer is disposed on the inner side of a door body and fixedly connected with the door body, and the drawer is pulled open when a user pulls the door body forwards.

Certain storage objects are usually contained in the drawer, and magnetic attraction force usually exists between the drawer door and a cabinet to realize sealing, which causes door opening resistance, so that the opening of the drawer door is laborious.

BRIEF DESCRIPTION OF THE INVENTION

An objective of the present invention is to provide a control method for a drawer door of a refrigerator and the refrigerator to solve the problem that the drawer door is not easy to open.

A further objective of the present invention is to enable the automatic door opening and closing process of the drawer door to be more controllable and achieve better man-machine interaction experience.

In one aspect, the present invention provides a control method for a drawer door of a refrigerator. The refrigerator includes a cabinet, a drawer door mounted in the cabinet in a manner of capable of being pushed and pulled front and back and a driving mechanism configured to controllably drive the drawer door to move front and back. The control method for the drawer door includes the following steps:

- obtaining a door opening instruction or a door closing instruction;
- controlling the driving mechanism to drive the drawer door to move forwards to be opened or move backwards to be closed;
- detecting a resistance on the drawer door during the movement;
- determining whether the resistance is larger than a preset resistance threshold value or not; and
- if yes, controlling the driving mechanism to stop running so as to enable the drawer door to stop moving.

Optionally, the refrigerator further includes a switch, and the method further includes the following step before the step of obtaining the door opening instruction or the door closing instruction:

- giving the door opening instruction when the switch is triggered in a closed static state of the drawer door; or

- giving the door closing instruction when the switch is triggered in a completely-opened static state of the drawer door.

Optionally, the method further includes the following steps after the step of controlling the driving mechanism to stop running so as to enable the drawer door to stop moving:

- detecting whether the switch is triggered or not; and
- if yes, controlling the driving mechanism to drive the drawer door to move towards a direction opposite to the direction in which the drawer door moves before stopping.

Optionally, the method further includes the following steps after the step of controlling the driving mechanism to stop running so as to enable the drawer door to stop moving:

- detecting whether the switch is triggered or not;
- if yes, controlling the driving mechanism to drive the drawer door to move towards a direction opposite to the direction in which the drawer door moves before stopping; and
- if no, controlling the driving mechanism to drive the drawer door to move backwards to be closed after a duration in which the drawer door stops moving reaches a preset time threshold value.

Optionally, the switch is a trigger switch.

Optionally, the method further includes the following steps before the step of obtaining the door opening instruction or the door closing instruction:

- detecting the magnitude of forward pulling force to the drawer door when the drawer door of the refrigerator is in a closed static state, and giving the door opening instruction if the magnitude of the pulling force is larger than a preset pulling force threshold value; and
- detecting the magnitude of backward pushing force to the drawer door when the drawer door of the refrigerator is in a completely-opened static state, and giving the door closing instruction if the magnitude of the pushing force is larger than a preset pushing force threshold value.

Optionally, the method of controlling the driving mechanism to drive the drawer door to move forwards to be opened or move backwards to be closed includes: controlling the driving mechanism to drive the drawer door to move forwards to be opened or move backwards to be closed in a manner of first accelerating and then decelerating.

In another aspect, the present invention further provides a refrigerator, including:

- a cabinet with a front side opened;
- a drawer door, including a door body and a drawer installed on a rear side of the door body, wherein the drawer is installed in the cabinet in a manner of capable of being pushed and pulled front and back;
- a driving mechanism, configured to controllably drive the drawer door to move forwards to be opened or move backwards to be closed; and
- a controller, including a memory and a processor, wherein a computer program is stored in the memory, and the computer program is configured to implement any one of the above control methods for the drawer door when executed by the processor.

Optionally, the driving mechanism includes at least one belt transmission mechanism and a motor, each belt transmission mechanism includes:

- two toothed belt wheels, spaced front and back and rotatably installed on a side wall of the cabinet respectively,
- a synchronous belt, tensioned on the two toothed belt wheels, and a connecting member, fixed to the synchronous belt and directly or indirectly fixed to the drawer door; and the motor is installed on the side wall of the cabinet, and is configured to directly or indirectly drive one toothed belt wheel to rotate so as to drive the synchronous belt to move, thereby driving the drawer door to move.

Optionally, the driving mechanism further includes:

a worm wheel, coaxially connected with one toothed belt wheel; and a worm, matched with the worm wheel and connected with a rotating shaft of the motor, so that the motor drives the worm to rotate to drive the worm wheel to rotate, thereby driving the toothed belt wheel to rotate.

In the control method for the drawer door of the present invention, the driving mechanism can be controlled to automatically open or close the drawer door, so that a user does not need to push and pull the drawer door laboriously. In addition, during the opening and closing process of the drawer door, emergency stop can be realized as long as enough resistance is applied, and the drawer door can stay at a position desired by the user. Therefore, the automatic opening and closing process of the drawer door is more controllable, better man-machine interaction experience is achieved, and a pinching injury or other injuries to the user caused by the uncontrollable movement process of the drawer door can be avoided.

Further, in the control method for the drawer door of the present invention, the refrigerator only needs to be provided with one switch, or the user only need to push or pull the drawer door slightly, and then the driving mechanism can be started, facilitating the use by the user.

According to the following detailed descriptions of specific embodiments of the present invention in conjunction with the drawings, those skilled in the art will more clearly understand the above and other objectives, advantages and features of the present invention.

BRIEF DESCRIPTION OF THE DRAWINGS

Some specific embodiments of the present invention are described in detail below with reference to the drawings by way of example and not limitation. The same reference numerals in the drawings indicate the same or similar components or parts. Those skilled in the art should understand that these drawings are not necessarily drawn in scale. In figures.

DETAILED DESCRIPTION

Figure 1:
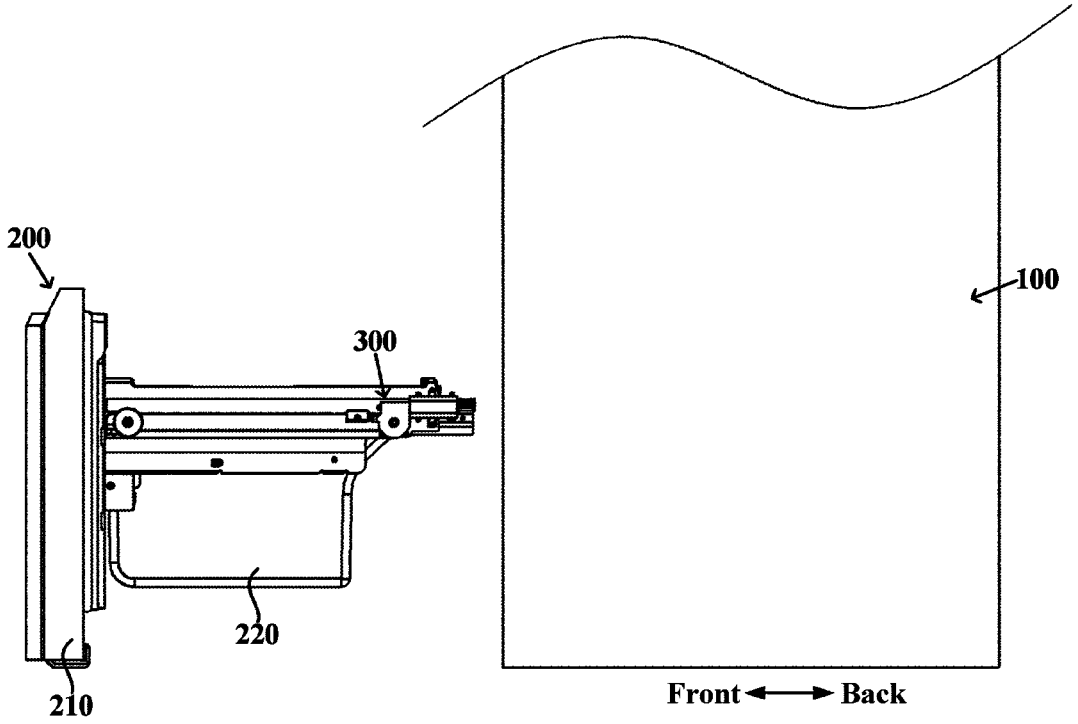
FIG. 1 is a schematic structural diagram of a refrigerator according to an embodiment of the present invention.
Figure 2:
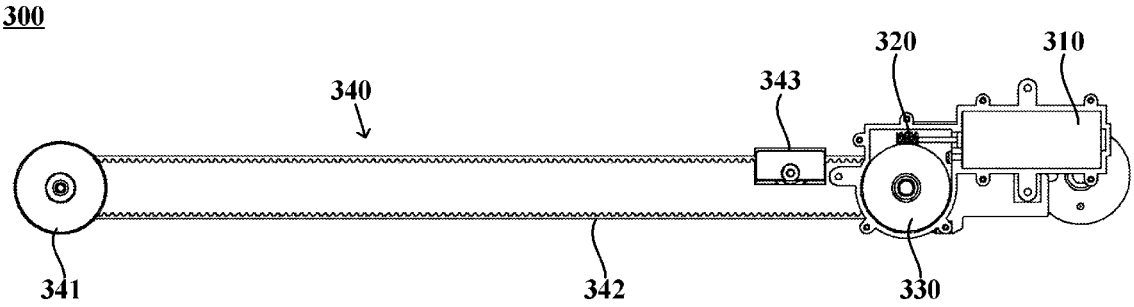
FIG. 2 is a schematic diagram of a driving mechanism of the refrigerator shown in FIG. 1.

The embodiment of the present invention provides a refrigerator. FIG. 1 is a schematic structural diagram of a refrigerator according to an embodiment of the present invention. FIG. 2 is a schematic diagram of a driving mechanism of the refrigerator shown in FIG. 1.

As shown in FIG. 1, the refrigerator includes a cabinet 100, a drawer door 200 and a driving mechanism 300. A front side of the cabinet 100 is opened to form an opening for containing the drawer door 200. The drawer door 200 is mounted in the cabinet 100 in a manner of capable of being pushed and pulled front and back. Specifically, the drawer door 200 includes a door body 210 and a drawer 220 installed at a rear side of the door body 210, and the drawer 220 is installed in the cabinet 100 in a manner of capable of being pushed and pulled front and back. The drawer 220 and an inner wall of the cabinet 100 can be connected to each other by a sliding rail assembly. The sliding rail assembly is very common in the prior art, so that a structure thereof will not be described here. The door body 210 closes the opening in the front side of the cabinet 100 when the drawer door 200 is in a completely-closed state (i.e., cannot continue to move backwards). The driving mechanism 300 is configured to controllably drive the drawer door 200 to move forwards to be opened or move backwards to be closed.

FIG. 2 illustrates an optional driving mechanism. The driving mechanism 300 includes at least one belt transmission mechanism 340 and a motor 310. Each belt transmission mechanism 340 includes two toothed belt wheels 341, a synchronous belt 342 and a connecting member 343. The two toothed belt wheels 341 are spaced front and back. The two toothed belt wheels 341 are rotatably installed on the inner wall of the cabinet 100 respectively, and the rotation axes thereof are in a transverse direction of the refrigerator (the left-right direction of a user is the transverse direction of the refrigerator when the user faces the refrigerator). The synchronous belt 342 is tensioned on the two toothed belt wheels 341. In other words, the synchronous belt 342 is in the shape of a loop and tightly sleeves the two toothed belt wheels 341. The toothed belt wheel 341 differs from a traditional belt wheel in that the toothed belt wheel 341 is provided with meshing teeth, and in cooperation therewith, the synchronous belt 342 is also provided with belt teeth so as to mesh with the toothed belt wheel 341. Due to the arrangement of the tooth meshing structure, transmission is more accurate, and synchronous transmission is basically realized. The connecting member 343 is fixed to the synchronous belt 342 and is directly or indirectly fixed to the drawer door 200. For example, the connecting member 343 may be fixed to a sliding rail which is directly connected with the drawer 220.

The motor 310 is installed on a side wall of the cabinet 100 and is configured to directly or indirectly drive one toothed belt wheel 341 to rotate, so that the toothed belt wheel 341 drives the synchronous belt 342 to move, and the synchronous belt 342 drives the drawer door 200 to move through the connecting member 343. In order to achieve opening and closing of the drawer door 200, the motor 310 is controllably rotate forwards and rotate reversely.

The number of the belt transmission mechanism 340 may be one. The two toothed belt wheels 341 of the belt transmission mechanism 340 may be installed on one side in a transverse direction of or below the drawer 220. It is also possible to make the number of the belt transmission mechanisms 340 be two. The toothed belt wheels 341 of the two belt transmission mechanisms 340 are installed on both sides in the transverse direction of the drawer 220 respectively, so that both sides of the drawer door 200 are driven, and the balance is better. A synchronous transmission shaft may be connected between the two belt transmission mechanisms 340 to enable synchronous movement between the two transmission mechanisms. In this way, only one motor needs to be disposed.

A speed reduction mechanism needs to be designed because a rotating speed of a general motor is high. For example, the motor 310 may drive the toothed belt wheel 341 to rotate by a worm and gear mechanism to achieve a speed reduction effect. Specifically, a worm wheel 330 and a worm 320 are disposed. The worm wheel 330 and one toothed belt wheel 341 are coaxially connected, and the two may be separate parts which are then connected, or may be an integral part. The worm 320 is matched with the worm gear 330 and connected with a rotating shaft of the motor 310, so that the motor 310 drives the worm 320 to rotate so as to drive the worm gear 330 to rotate, thereby driving the toothed belt wheel 341 to rotate.

Figure 3:
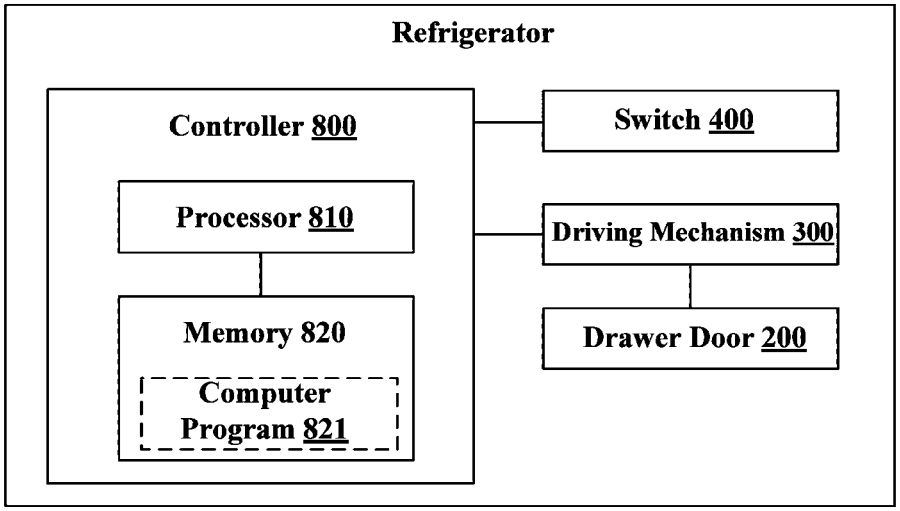
FIG. 3 is a schematic block diagram of a refrigerator according to an embodiment of the present invention.

FIG. 3 is a schematic block diagram of a refrigerator according to an embodiment of the present invention. As shown in FIG. 3, the refrigerator further includes a controller 800. The controller 800 includes a processor 810 and a memory 820. A computer program 821 is stored in the memory 820. In addition, when the computer program 821 is run, the controller 800 is made to execute the control method for the drawer door of the refrigerator according to the embodiment of the present invention for controlling the driving mechanism, so that an automatic opening and closing process of the drawer door is more controllable, and better man-machine interaction experience is achieved.

The memory 820 may be electronic memories such as flash memory, EEPROM, EPROM, hard disk, or ROM, and the memory 820 has a memory space of the computer program 821 for executing any of the method steps of the above methods. By means of running of the computer program 821, the controller 800 executes all of the steps in the method described above.

Figure 4:
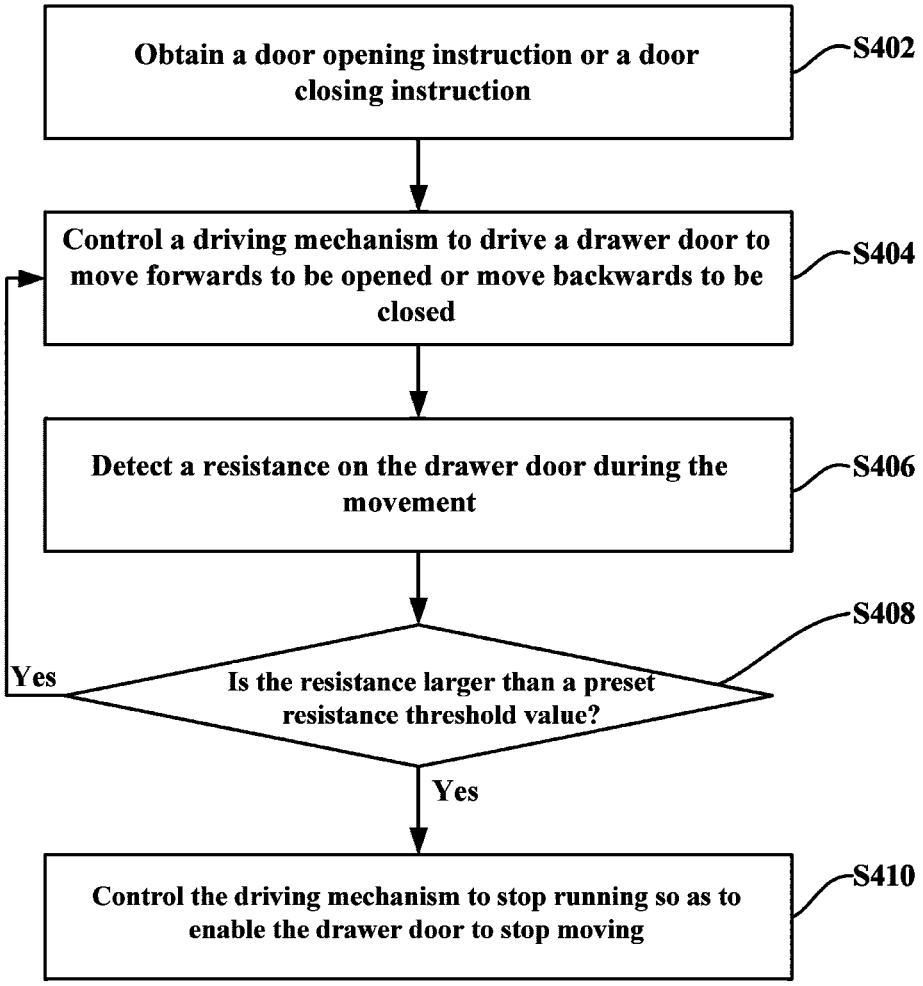
FIG. 4 is a schematic diagram of a control method for a drawer door of a refrigerator according to an embodiment of the present invention.

The present invention further provides a control method for a drawer door of a refrigerator. FIG. 4 is a schematic diagram of a control method for a drawer door of a refrigerator according to an embodiment of the present invention. As shown in FIG. 4, the control method for the drawer door of the present invention may include the following steps:

Step S402: obtaining a door opening instruction or a door closing instruction.

In this step, in response to a control instruction for a drawer door sent by a user, the controller 800 determines whether the control instruction is the door opening instruction or the door closing instruction.

For example, a switch 400 in signal connection with the controller 800 may be disposed on the refrigerator. The switch may be a mechanical switch, preferably a touch switch. As the user triggers the switch when a drawer door 200 is in a closed static state (i.e., in the closed state and not moving), the switch will give the door opening instruction. As the switch is triggered by the user when the drawer door 200 is in a completely-opened static state, the switch 400 will give the door closing instruction.

Alternatively, a plurality of pressure sensors may be disposed on the drawer door 200 to sense the magnitude and direction of acting force to an outer surface of the drawer door 200 and generate an electrical signal to be transmitted to the controller 800. The plurality of pressure sensors cover all areas, which can be touched by the user, of the outer surface of the drawer door. When the drawer door 200 is in the closed static state, the pressure sensor detects the magnitude of forward pulling force to the drawer door 200. If the magnitude of the pulling force is larger than a preset pulling force threshold value, the door opening instruction is given. When the drawer door 200 is in the completely-opened static state, the pressure sensor detects the magnitude of backward pushing force to the drawer door 200. If the magnitude of the backward pushing force is larger than a preset pushing force threshold value, the door closing instruction is given.

Alternatively, the door opening instruction or the door closing instruction may be given by other means such as physical remote control and voice sound control.

Step S404: controlling a driving mechanism to drive the drawer door to move forwards to be opened or move backwards to be closed. That is, when the door opening instruction is obtained, the driving mechanism is controlled to drive the drawer door to move forwards to be opened. When the door closing instruction is obtained, the driving mechanism is controlled to drive the drawer door to move backwards to be closed.

Step S406: detecting a resistance on the drawer door during the movement.

The resistance can be detected by the foregoing plurality of pressure sensors disposed on the drawer door. When the drawer door moves forwards to be opened, backward acting force received is defined as resistance. When the drawer door moves backwards to be closed, forward acting force received is defined as resistance.

Step S408: determining whether the resistance is larger than a preset resistance threshold value or not. When the result is yes, the step S410 is executed. When the result is no, the step S404 is executed, so that the drawer door is still normally opened or closed.

This allows subsequent steps to be executed only when the drawer door indeed experience the resistance applied by the user, and the interference of a slight, accidental touch is eliminated. The preset resistance threshold value can be set through multiple tests.

Step S410: controlling the driving mechanism to stop running so as to enable the drawer door to stop moving.

According to the present invention, the drawer door is driven by the driving mechanism to move front and back. Therefore, the automatic door opening and closing are achieved, laborious operation of the user is avoided, and the use is quite convenient.

In addition, in the opening and closing process, the drawer door can realize emergency stop as long as sufficient resistance is applied, so that the drawer door stays at a position desired by the user, which not only enables the automatic door opening and closing process of the drawer door to be more controllable, achieves better man-machine interaction experience, but also avoids the situation that the user is carelessly clamped between the drawer door and a front side of a cabinet when the drawer door is closed or the situation that user is carelessly ejected by the drawer door when the drawer door is opened.

In some optional embodiments, the steps above may be further optimized and configured to achieve better technical effects. The control method of the refrigerator of the present embodiment is described in detail with reference to the description of an optional execution flow of the present embodiment. The embodiment is merely illustration of the execution flow. In specific implementation, the execution sequence and running conditions of some steps can be modified according to specific implementation requirements.

Figure 5:
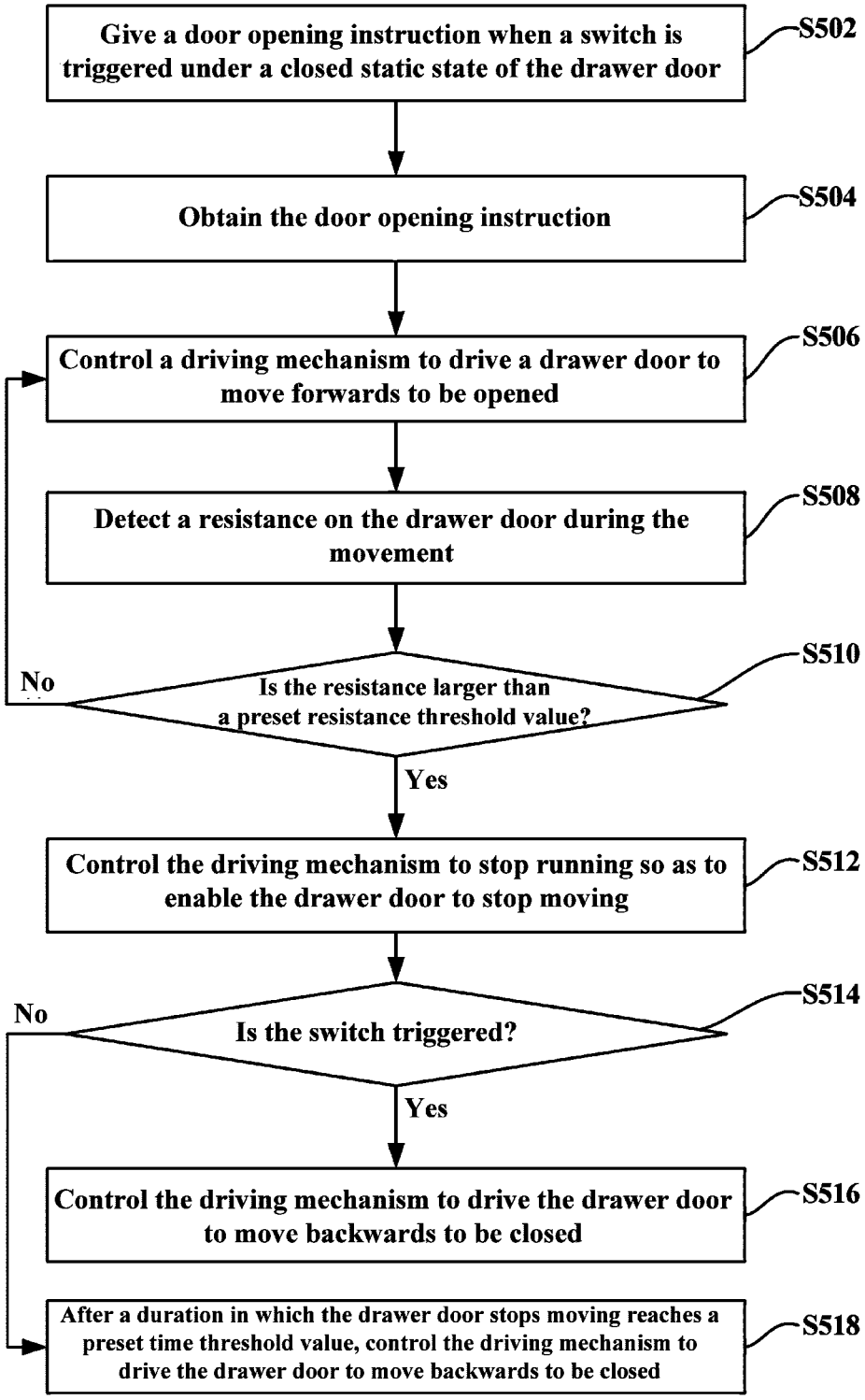
FIG. 5 is a flow diagram of door opening of a control method for a drawer door of a refrigerator according to an embodiment of the present invention.

FIG. 5 is flow diagram of door opening of a control method for a drawer door of a refrigerator according to an embodiment of the present invention. As shown in FIG. 5, in this embodiment, when the control method for the drawer door controls a door to be opened, the following steps are sequentially executed:

Step S502: when a switch is triggered under a closed static state of the drawer door, a door opening instruction is given.

Step S504: the door opening instruction is obtained.

Step S506: a driving mechanism is controlled to drive the drawer door to move forwards to open the door.

In this step, the driving mechanism may be controlled to drive the drawer door to move forwards to be opened in a manner of first accelerating and then decelerating, so that safety is achieved, and time is saved for a user.

For example, a complete door opening cycle is divided into early, middle, and later time periods. In the early period of door opening, the drawer door is made to move forwards at a relatively low speed. In the middle period of door opening, the drawer door is made to move forwards at a relatively high speed. In the later period of door opening, the drawer door is made to move forwards at a relatively low speed. Or the drawer door is made to continuously accelerate to reach a maximum speed and then continuously decelerate.

Step S508: a resistance on the drawer door during the movement is detected.

Step S510: whether the resistance is larger than a preset resistance threshold value or not is determined. When the result is yes, the step S512 is executed. When the result is no, the step S506 is executed, so that the drawer door is still normally opened.

Step S512: the driving mechanism is controlled to stop running so as to stop moving the drawer door.

Step S514: during the period in which the drawer door stops moving, whether the switch is triggered or not is determined. If yes, the step S516 is executed. If no, the step S518 is executed.

Step S516: the driving mechanism is controlled to drive the drawer door to move towards a direction opposite to the direction in which the drawer door moves before stopping. That is, the driving mechanism is controlled to drive the drawer door to move backwards to be closed. In this way, if the user is pinched or pushed, the drawer door is reversely moved by triggering the switch, such that the harm to human bodies can be timely eliminated.

Step S518: after a duration in which the drawer door stops moving reaches a preset time threshold value, the driving mechanism is controlled to drive the drawer door to move backwards to be closed. The preset time threshold value may be set to 1 min, 2 min, 3 min, etc. In this way, the excessive loss of cold air of the refrigerator caused by the fact that the user temporarily goes away and forgets to close the door is avoided.

Figure 6:
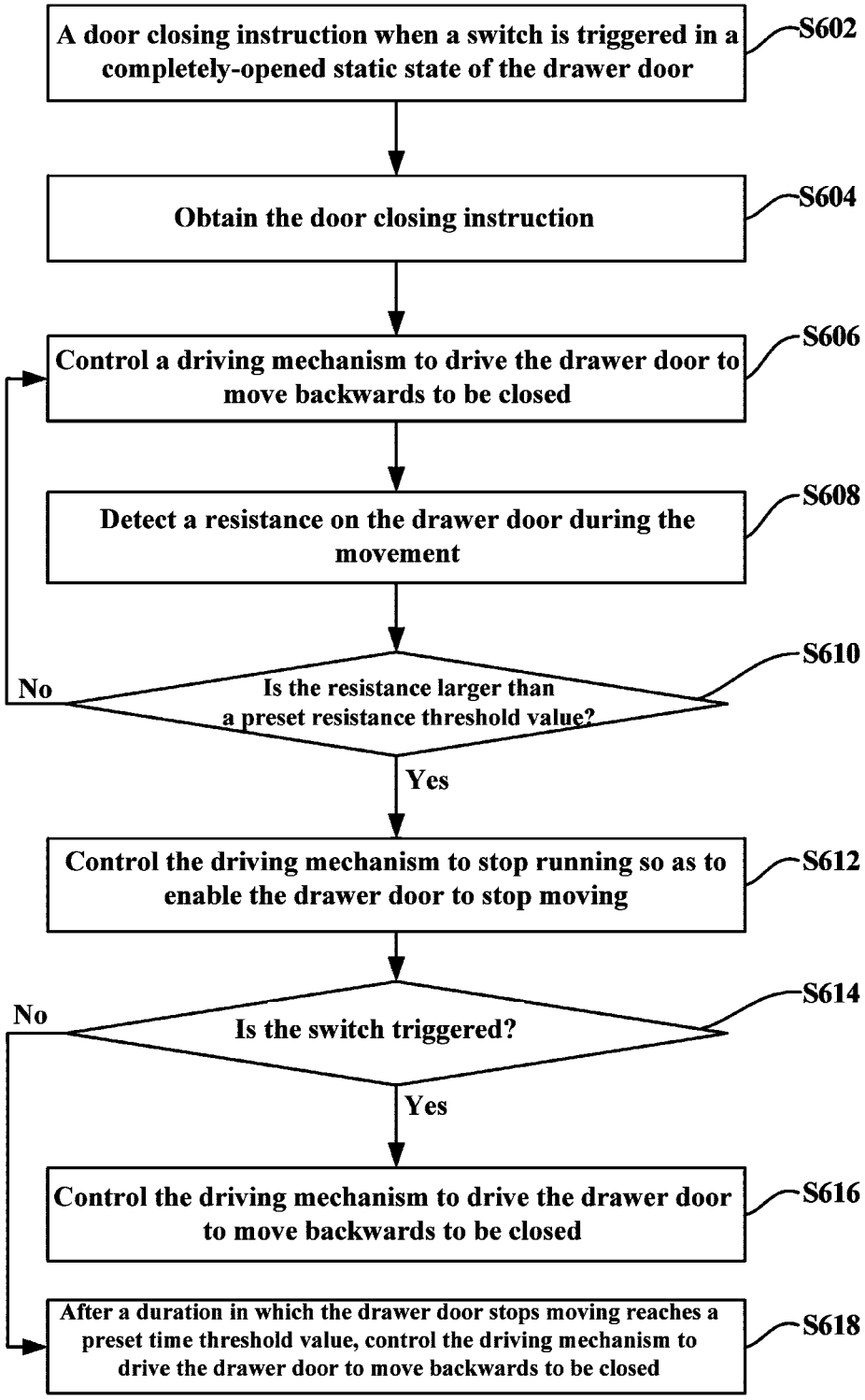
FIG. 6 is a flow diagram of door closing of a control method for a drawer door of a refrigerator according to an embodiment of the present invention.

FIG. 6 is a flow diagram of door closing of a control method for a drawer door of a refrigerator according to an embodiment of the present invention. As shown in FIG. 6, in this embodiment, when controlling a door to be closed, the control method for the drawer door sequentially executes the following steps:

Step S602: when a switch is triggered under a completely-opened static state of the drawer door, a door closing instruction is given.

Step S604: the door closing instruction is obtained.

Step S606: a driving mechanism is controlled to drive the drawer door to move backwards to be closed.

In this step, the driving mechanism may be controlled to drive the drawer door to be closed in a manner of first accelerating and then decelerating, so that safety is achieved, and time is saved for a user.

For example, a complete door closing cycle is divided into three periods. In the early period of door closing, the drawer door is made to move backwards at a relatively low speed. In the middle period of door closing, the drawer door is made to move backwards at a relatively high speed. In the later period of door closing, the drawer door is made to move backwards at a relatively low speed. Or the drawer door is made to continuously accelerate to reach a maximum speed and then continuously decelerate.

Step S608: a resistance on the drawer door during the movement is detected.

Step S610: whether the resistance is larger than a preset resistance threshold value or not is determined. When the result is yes, the step S612 is executed. When the result is no, the step S606 is executed, so that the drawer door is still normally closed.

Step S612: the driving mechanism is controlled to stop running so as to stop moving the drawer door.

Step S614: during the period in which the drawer door stops moving, whether the switch is triggered or not is determined. If yes, the step S616 is executed. If no, the step S618 is executed.

Step S616: the driving mechanism is controlled to drive the drawer door to move towards a direction opposite to the direction in which the drawer door moves before stopping. That is, the driving mechanism is controlled to drive the drawer door to move forwards to be opened. In this way, if the user is pinched or pushed, the drawer door is reversely moved by triggering the switch, such that the harm to human bodies can be timely eliminated.

Step S618: after a duration in which the drawer door stops moving reaches a preset time threshold value, the driving mechanism is controlled to drive the drawer door to move backwards to be closed. The preset time threshold value may be set to 1 min, 2 min, 3 min, etc. In this way, the excessive loss of cold air of the refrigerator caused by the fact that the user temporarily goes away and forgets to close the door is avoided.

Hereto, those skilled in the art should realize that although multiple exemplary embodiments of the present invention have been shown and described in detail herein, without departing from the spirit and scope of the present invention, many other variations or modifications that conform to the principles of the present invention can still be directly determined or deduced from the contents disclosed in the present invention. Therefore, the scope of the present invention should be understood and recognized as covering all these other variations or modifications.

The invention claimed is:

1. A control method for a drawer door of a refrigerator, wherein the refrigerator comprises a cabinet, a drawer door mounted in the cabinet in a manner of capable of being pushed and pulled front and back and a driving mechanism configured to controllably drive the drawer door to move front and back, the refrigerator further comprises a switch, and the control method for the drawer door comprises the following steps:

obtaining a door opening instruction or a door closing instruction;

controlling the driving mechanism to drive the drawer door to move forwards to be opened or move backwards to be closed;

detecting a resistance on the drawer door during the movement;

determining whether the resistance is larger than a preset resistance threshold value or not;

if yes, controlling the driving mechanism to stop running so as to enable the drawer door to stop moving;

detecting whether the switch is triggered or not; and if yes, controlling the driving mechanism to drive the drawer door to move towards a direction opposite to the direction in which the drawer door moves before stopping, wherein the method further comprises the following step before the step of obtaining the door opening instruction or the door closing instruction:

giving the door opening instruction when the switch is triggered in a closed static state of the drawer door; or giving the door closing instruction when the switch is triggered in a completely-opened static state of the drawer door.

2. The control method for the drawer door of claim 1, further comprising the following steps after the step of controlling the driving mechanism to stop running so as to enable the drawer door to stop moving:

if the switch is not triggered, controlling the driving mechanism to drive the drawer door to move backwards to be closed after a duration in which the drawer door stops moving reaches a preset time threshold value.

3. The control method for the drawer door of claim 1, wherein the switch is a trigger switch.

4. The control method for the drawer door of claim 1, further comprising the following steps before the step of obtaining the door opening instruction or the door closing instruction:

detecting the magnitude of forward pulling force to the drawer door when the drawer door of the refrigerator is in a closed static state, and giving the door opening instruction if the magnitude of the pulling force is larger than a preset pulling force threshold value; and detecting the magnitude of backward pushing force to the drawer door when the drawer door of the refrigerator is in a completely-opened static state, and giving the door closing instruction if the magnitude of the pushing force is larger than a preset pushing force threshold value.

5. The control method for the drawer door of the claim 1, wherein the method of controlling the driving mechanism to drive the drawer door to move forwards to be opened or move backwards to be closed comprises:

controlling the driving mechanism to drive the drawer door to move forwards to be opened or move backwards to be closed in a manner of first accelerating and then decelerating.

6. A refrigerator, comprising:

a cabinet with a front side opened;

a drawer door, comprising a door body and a drawer installed at a rear side of the door body, wherein the drawer is installed in the cabinet in a manner of capable of being pushed and pulled front and back;

a driving mechanism, configured to controllably drive the drawer door to move forwards to be opened or move backwards to be closed; and a controller, comprising a memory and a processor, wherein a computer program is stored in the memory, and the computer program is configured to implement a control method for the door of claim 1 executed by the processor.

7. The refrigerator of the claim 6, wherein the driving mechanism comprises at least one belt transmission mechanism and a motor, each of the belt transmission mechanisms comprises:

two toothed belt wheels, spaced front and back and rotatably installed on a side wall of the cabinet respectively, a synchronous belt, tensioned on the two toothed belt wheels, a connecting member, fixed to the synchronous belt and directly or indirectly fixed to the drawer door, and the motor is installed on the side wall of the cabinet, and is configured to directly or indirectly drive one of the toothed belt wheels to rotate so as to drive the synchronous belt to move, thereby driving the drawer door to move.

8. The refrigerator of the claim 7, wherein the driving mechanism further comprises:

a worm wheel, coaxially connected with one of the toothed belt wheels; and a worm, matched with the worm wheel and connected with a rotating shaft of the motor, so that the motor drives the worm to rotate so as to drive the worm wheel to rotate, thereby driving the toothed belt wheel to rotate.

* * * * *